US009556650B1

(12) United States Patent
Lai

(10) Patent No.: US 9,556,650 B1
(45) Date of Patent: Jan. 31, 2017

(54) HIGH SECURITY COMBINATION PADLOCK

(71) Applicant: THE SUN LOCK COMPANY, LTD., Tuen Mun, N. T. (HK)

(72) Inventor: Karl Lai, Tai Po (HK)

(73) Assignee: The Sun Lock Company, Ltd., Tuen Mun, N.T. (HK)

( * ) Notice: Subject to any disclaimer, the term of this patent is extended or adjusted under 35 U.S.C. 154(b) by 0 days.

(21) Appl. No.: 15/180,307

(22) Filed: Jun. 13, 2016

Related U.S. Application Data

(60) Provisional application No. 62/288,070, filed on Jan. 28, 2016.

(51) Int. Cl.

| | |
|---|---|
| ***E05B 37/02*** | (2006.01) |
| ***E05B 67/22*** | (2006.01) |
| ***E05B 67/02*** | (2006.01) |
| ***E05B 37/00*** | (2006.01) |

(52) U.S. Cl.
CPC ..... *E05B 37/025* (2013.01); *E05B 37/0003* (2013.01); *E05B 37/0006* (2013.01); *E05B 37/0048* (2013.01); *E05B 67/02* (2013.01); *E05B 67/22* (2013.01); *Y10T 70/424* (2015.04)

(58) Field of Classification Search
CPC .... E05B 37/025; E05B 37/0003; E05B 67/22; E05B 37/0048; E05B 37/0006; E05B 67/02; E05B 37/02; E05B 37/0058; E05B 37/10; Y10T 70/417; Y10T 70/422; Y10T 70/424; Y10T 70/426
USPC ..... 70/20–26, 28, 30, 38 A, 51–53, 311, 312,70/323, 324, 329
See application file for complete search history.

(56) References Cited

U.S. PATENT DOCUMENTS

| | | | | |
|---|---|---|---|---|
| 5,953,940 | A * | 9/1999 | Ling | E05B 37/025 70/20 |
| 6,796,152 | B1 * | 9/2004 | Yu | E05B 73/0082 439/133 |
| 7,698,914 | B2 * | 4/2010 | Ma | E05B 37/025 70/22 |
| 2006/0027001 | A1 * | 2/2006 | Lai | E05B 37/0034 70/25 |
| 2007/0220929 | A1 * | 9/2007 | Green | E05B 37/025 70/25 |
| 2009/0113947 | A1 * | 5/2009 | Lai | E05B 35/105 70/21 |
| 2010/0095718 | A1 * | 4/2010 | Lai | E05B 35/105 70/21 |

* cited by examiner

*Primary Examiner* — Lloyd Gall
(74) *Attorney, Agent, or Firm* — Ware, Fressola, Maguire & Barber LLP

(57) ABSTRACT

A padlock has a shackle with a short leg and a long leg and a lock body having two partial channels to accommodate the short and long legs. Each of the short and long legs has a bolt groove to receive a bolt. The lock body also has a through channel for placing a spindle having a locking area and an unlocking groove. A plurality of dials and clutches mounted on the spindle control the spindle movement. When the padlock is in the locked mode, the spindle is located within the through channel such that the locking area pushes the bolts against the bolt grooves, preventing the shackle from being pulled upward. When dials match the combination code, the spindle can move upward to allow the bolts to move away from the bolt grooves toward the unlocking groove and the shackle can be pulled upward to unlock the padlock.

11 Claims, 7 Drawing Sheets

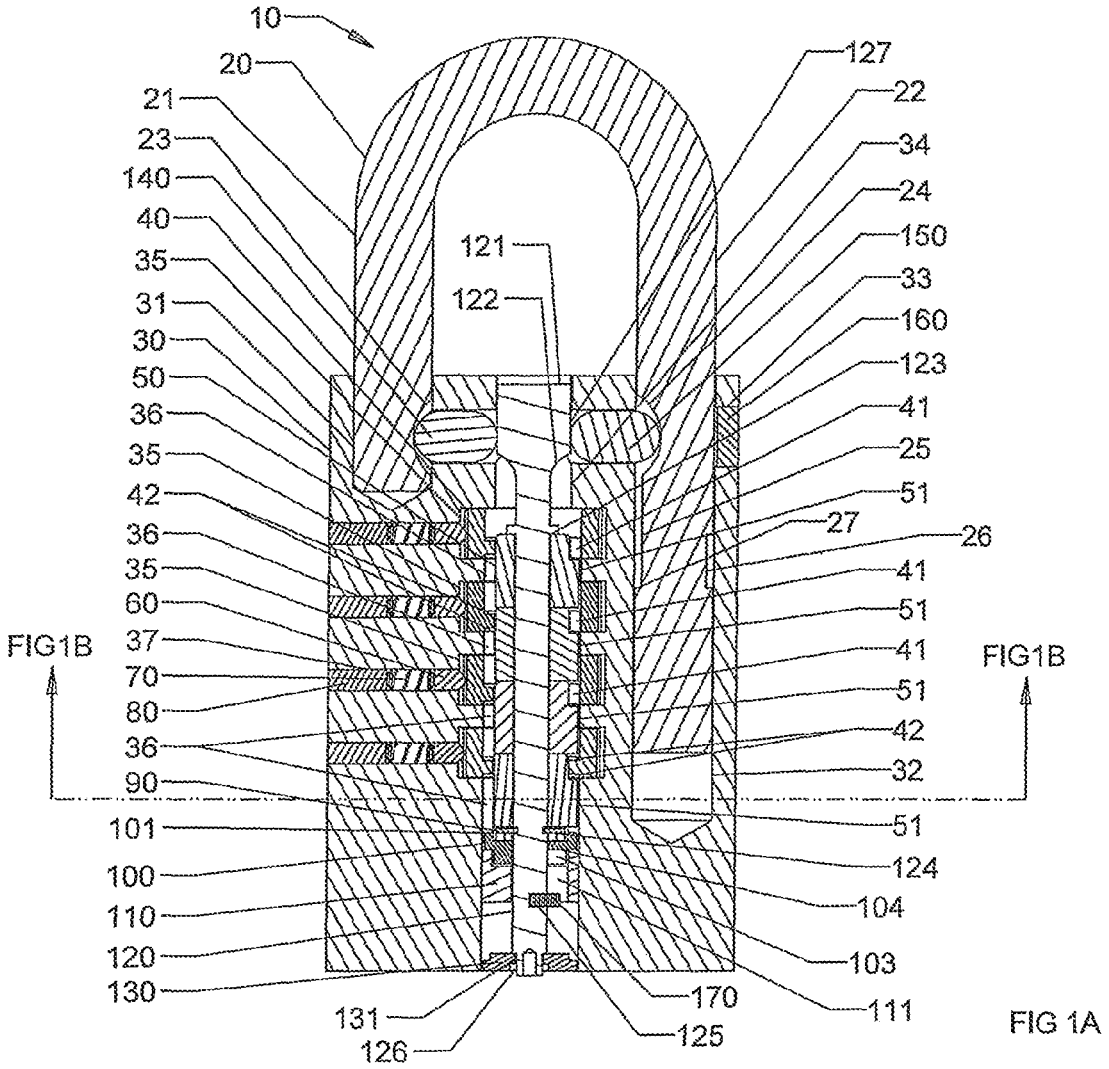
FIG 1A
FIG 1B
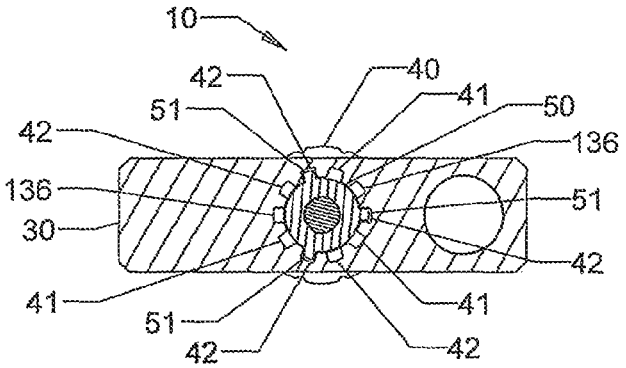

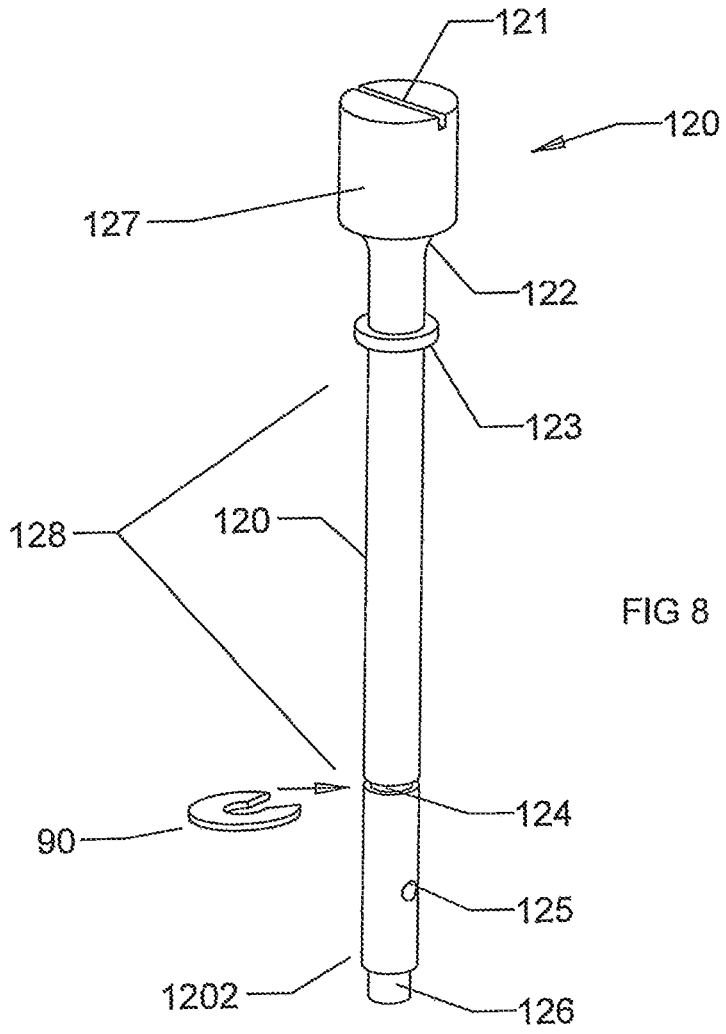
FIG 8
FIG 9A
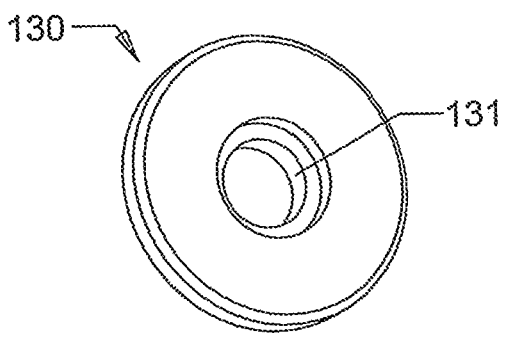
FIG 9B
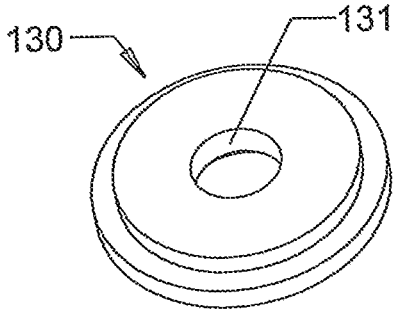

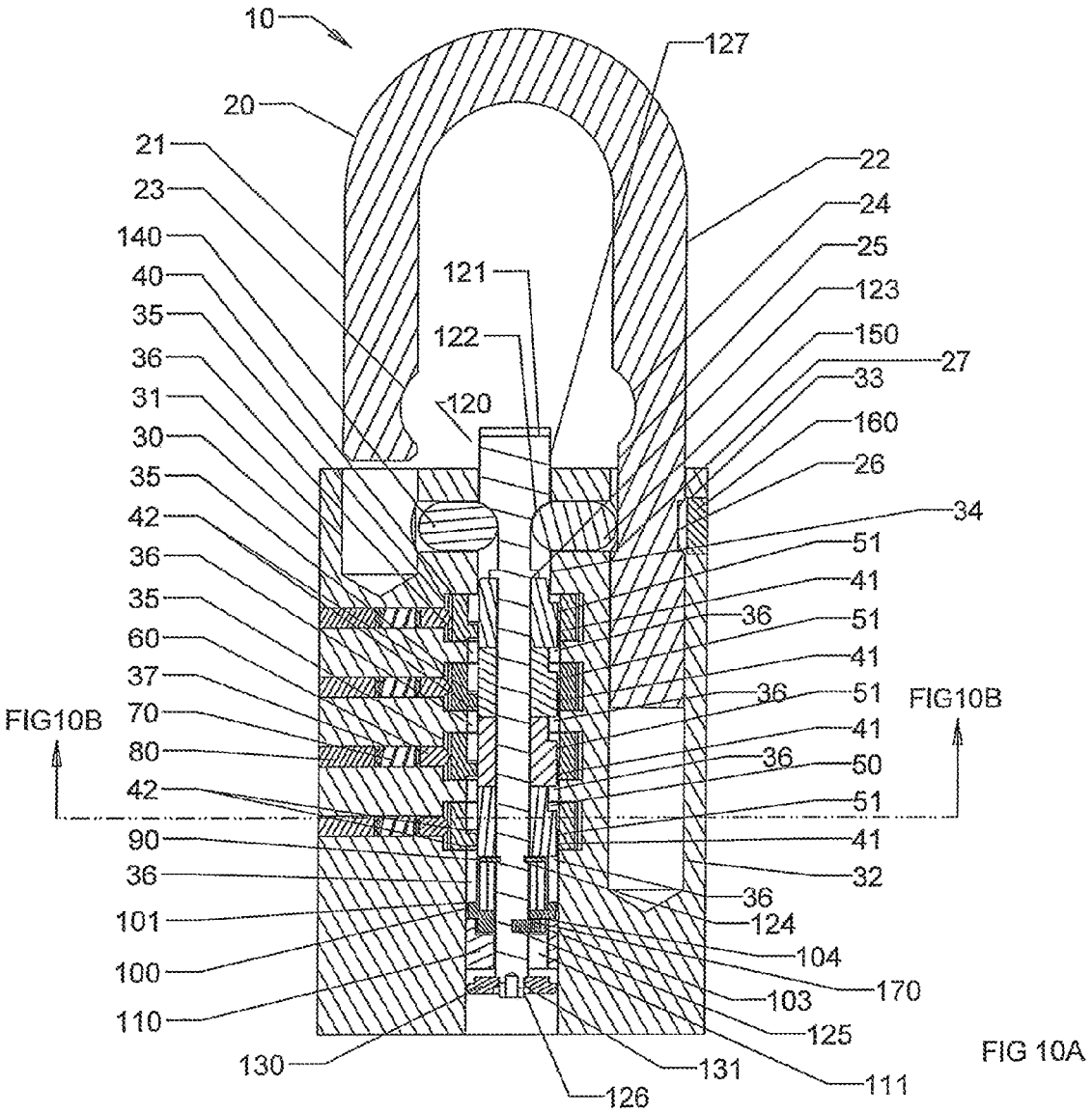
FIG 10A
FIG 10B
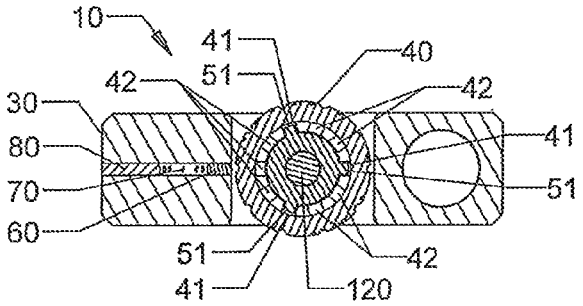

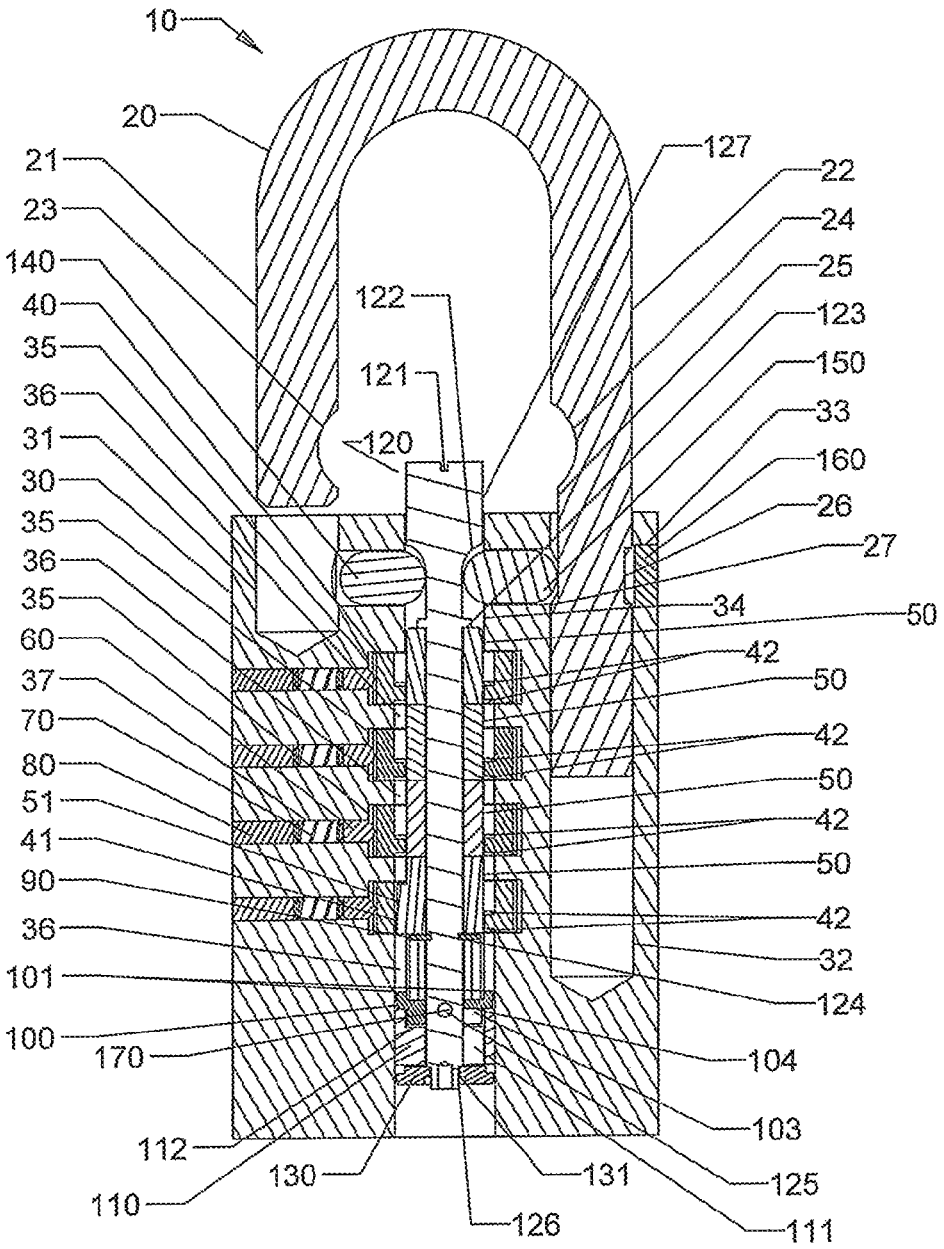
FIG 11A
FIG 11B
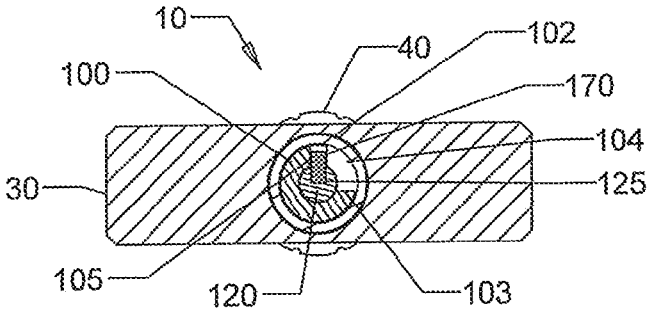

HIGH SECURITY COMBINATION PADLOCK

CROSS REFERENCE TO RELATED PATENT APPLICATION

This application claims priority under 35 USC §119 to U.S. Provisional Patent Application No. 62/288,070, filed Jan. 28, 2016, whose entire contents are hereby incorporated by reference.

TECHNICAL FIELD

The present invention relates to padlocks and, more particularly, to combination padlocks constructed for use in high integrity, secure applications.

BACKGROUND OF THE INVENTION

Numerous lock constructions have been developed and are widely employed by individuals to prevent unauthorized persons from gaining access to any area which has been closed and locked. Although many locks are constructed to be opened by a key, numerous combination locks have been developed which are opened by knowledge of a particular combination.

One particular type of combination lock that has become very popular, due to its ease and convenience of use, is a combination lock which employs a plurality of rotatable independent dials, each of which comprises a plurality of indicia, usually numbers or letters, which define the combination for releasing the lock. Although locks of this general nature had been available for several decades, these prior art combination lock constructions are typically employed in low security areas, due to their inability to resist forced entries in which excessive force is applied to the lock.

In those areas wherein a high security lock system is required, prior art constructions have relied upon padlocks which require a key for operating the lock between its alternate open position and closed position. Due to the ease with which keys are often lost or misplaced, as well as the proliferation of the keys required for many individuals to carry, high security padlocks requiring keys for operation have become increasingly unpopular. However, prior art constructions have been incapable of providing a high security padlock incorporating a combination system for operating the padlock, either independently or in combination with a key.

The present invention provides a combination padlock for effective operation in high security operations. The combination padlock has a lock body constructed as a single piece to enhance the durability of the padlock in tensile test and impact test.

SUMMARY OF THE INVENTION

The present invention provides a padlock having a lock body that has two partial channels to accommodate the short leg and long leg of a shackle. Each of the short and long legs has a bolt groove to receive a bolt. The lock body also has a through channel for placing a spindle having a locking area and an unlocking groove. The padlock has a plurality of dials and clutches mounted on the spindle to control the spindle movement. When the padlock is in the locked mode, the spindle is located within the through channel such that the locking area pushes the bolts against the bolt grooves, preventing the shackle from being pulled upward to release the short leg from the lock body. When dials match the combination code, the spindle can move upward to allow the bolts to move away from the bolt grooves toward the unlocking groove and the shackle can be pulled upward to unlock the padlock.

Thus, one aspect of the present invention is a padlock operable at least in a locked mode and in an opened mode, the padlock comprising:

a lock body comprising a first surface and a second surface, a short-leg locking hole and a long-leg locking channel made on the first surface into part of the lock body, and a spindle channel extending from the first surface to the second surface;

a shackle locatable in a first shackle position when the padlock is operated in the locked mode, and in a second shackle position when the padlock is operated in the opened mode, the shackle having a short leg, a long leg, a first bolt groove formed on the short leg and a second bolt groove formed on the long leg, the long leg arranged for placement in the long-leg locking channel, the short leg arranged to engage with the short-leg locking hole when the shackle is in the first shackle position, and to disengage from the short-leg locking hole when the shackle is in the second shackle position;

a first bolt arranged to engage the first bolt groove inside the lock body;

a second bolt arranged to engage the second bolt groove inside the lock body;

a spindle dimensioned for placement in the spindle channel, the spindle having a locking area adjacent to the first surface of the lock body, a clutch-mounting portion, and an unlocking groove located between the locking area and clutch-mounting portion, the spindle locatable in a first spindle position and a second spindle position;

a plurality of clutches rotatably mounted on the clutch-mounting portion of the spindle;

a plurality of dials positioned in relationship to the plurality of clutches so as to lock the spindle in the first spindle position or to allow the spindle to move in a first direction from the first spindle position to the second spindle position, wherein when the spindle is in the first spindle position, the spindle is substantially located within the spindle channel such that the locking area of the spindle is arranged to engage the first bolt with the first bolt groove and to engage the second bolt with the second bolt groove so as to secure the shackle in the first shackle position; and when the spindle is in the second spindle position, a portion of the spindle is located outside the spindle channel such that the locking area of the spindle is spaced from the first bolt and the second bolt, allowing the first bolt to move away from the first bolt groove toward the unlocking groove and the second bolt to move away from the second bolt groove toward the unlocking groove so as to allow the shackle to move from the first shackle position to the second shackle position.

According to an embodiment of the present invention, each of the clutches has an outer surface and at least one fin extended from the outer surface, and each of the dials has an inner surface, an extended inner ring extended from the inner surface, and at least one open slot made on the extended inner ring, said at least one open slot dimensioned to receive said at least one fin of a clutch, wherein the lock body comprises a plurality of dial slots, each dial slot dimensioned to receive one of the dials, and a plurality of fin slots, each fin slot dimensioned to receive said at least one fin of one of the clutches, and wherein the plurality of dials and the plurality of clutches are arranged to form a plurality of dial-clutch pairs, each dial-clutch pair having a clutch and an associated dial, wherein when the padlock is operated in the locked mode, said at least one fin of the clutch in a dial-clutch pair is engaged with the associated fin slot of the lock body but disengaged from said at least one open slot of the associated dial so as to allow the dial to rotate relative to the spindle, and when the padlock is operated in the opened mode, said at least one fin of the clutch is partially engaged with said at least one open slot of the associated dial and partially engaged with the associated fin slot of the lock body, so as to prevent both the dial and the clutch from rotation relative to the spindle.

According to an embodiment of the present invention, when the padlock is operated in the locked mode, the spindle is prevented from moving in the first direction if, in at least one of the dial-clutch pairs, said at least one fin of the clutch is misaligned with said at least one open slot of the dial.

According to an embodiment of the present invention, when the padlock is operated in the locked mode and, in each of the dial-clutch pairs, said at least one fin of the clutch aligns with said at least one open slot of the dial according to a combination code, the spindle is allowed to move in the first direction from the first spindle position to the second spindle position.

According to an embodiment of the present invention, the spindle has a first end having the locking area and an opposing second end, the spindle further comprising a reset pin fixedly attached to the spindle near the second end, a directional plate movably mounted on the spindle between the clutch-mounting portion and the reset pin, and an end plug movably mounted on the spindle in relationship to the reset pin, the end plug having a pin channel arranged to receive the reset pin such that when the spindle is in the first spindle position, the reset pin is located in the pin channel of the end plug, preventing the spindle from rotating relative to the lock housing.

According to an embodiment of the present invention, the directional plate has a plate surface positioned in relationship with the end plug such that when the spindle is moved from the first spindle position to the second spindle position, the reset pin is caused to move out of the pin channel of the end plug and to contact the plate surface of the directional plate, the plate surface configured to prevent the spindle from moving in the first direction further from the second spindle position.

According to an embodiment of the present invention, when the spindle is in the second spindle position, the spindle, along with the reset pin, is allowed to rotate relative to the end plug, and wherein the directional plate further has a plate channel arranged such that when the reset pin aligns with the plate channel, the spindle can be caused to move in the first direction further from the second spindle position so that said at least one fin of each of the clutches is disengaged from the associated fin slot of the lock body while engaging with said at least one open slot of the associated dial, allowing a user to rotate one or more of the dials along with the clutches to change the combination code.

According to an embodiment of the present invention, the extended inner ring has a thickness and each of said at least one open slot is made on the ring through the thickness, and wherein each of the dials further comprises a plurality of faulty notches made on the ring through only a part of the thickness such that when the clutch in a dial-clutch pair is caused to rotate relative to the associated dial, said at least one fin of the clutch is arranged to rub against the faulty notches of the associated dial.

According to an embodiment of the present invention, the faulty notches are configured to produce a clicking sound when said at least one fin of the clutch rubs against the faulty notches of the associated dial.

According to an embodiment of the present invention, the at least one fin comprises a plurality of fins distributed on the outer surface of each of the clutches, and said at least one opening slot comprises a plurality of opening slots distributed on the extended inner ring of each of the dials.

According to an embodiment of the present invention, the plurality of fins are distributed on the outer surface of each of the clutches in a fin distribution pattern, and the plurality of opening slots are distributed on the extended inner ring of each of the dials in a slot distribution pattern matching the fin distribution pattern such that the plurality of opening slots on each of the dials are configured to receive the plurality of fins of an associated clutch in only one manner.

The present invention will become apparent upon reading the description in conjunction with the drawings (FIGS. 1A-11B).

BRIEF DESCRIPTION OF THE DRAWINGS

FIG. 1A is a cross sectional side view of the padlock in the locked mode.

FIG. 1B is a cross sectional bottom view of the padlock of FIG. 1A.

FIG. 8 is an isometric view of the spindle.

FIGS. 9A and 9B are different views of the button.

FIG. 10A is a cross sectional side view of padlock in the opened mode.

FIG. 10B is a cross sectional bottom view of the padlock of FIG. 10A.

FIG. 11A is a cross sectional side view of padlock in the rest mode.

FIG. 11B is a bottom view of the padlock of FIG. 11A.

DETAILED DESCRIPTION OF THE INVENTION

Figure 2A:
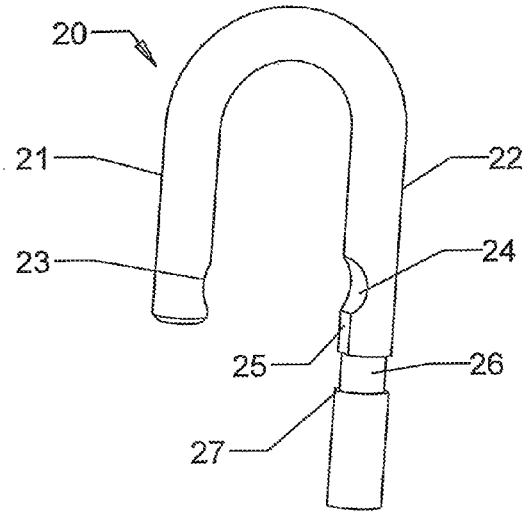
FIGS. 2A and 2B are different side views of the shackle.
Figure 2B:
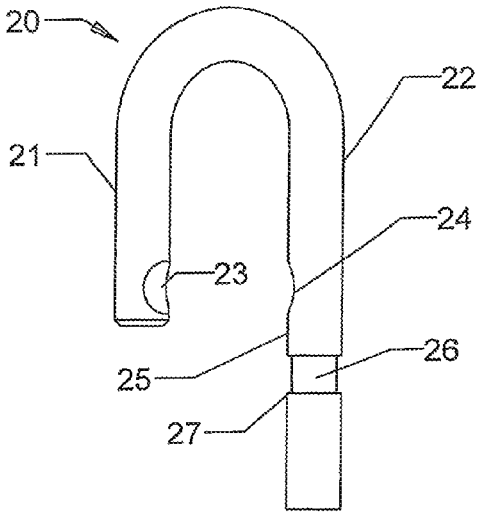
Figure 3A:
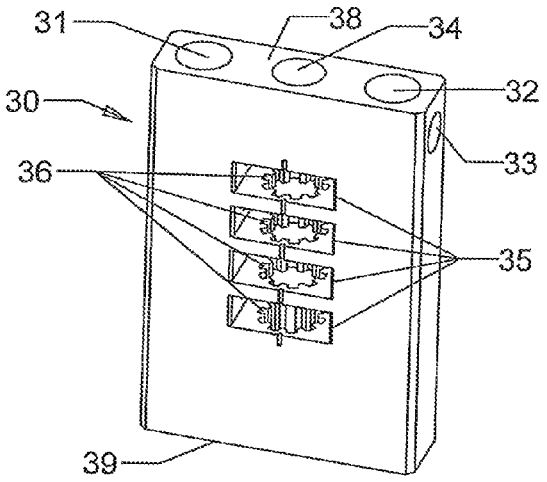
FIG. 3A is a side view showing the top of the lock body.
Figure 3B:
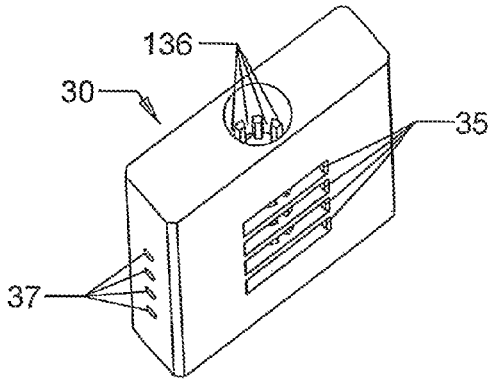
FIG. 3B is a side view showing the bottom of the lock body.
Figure 4A:
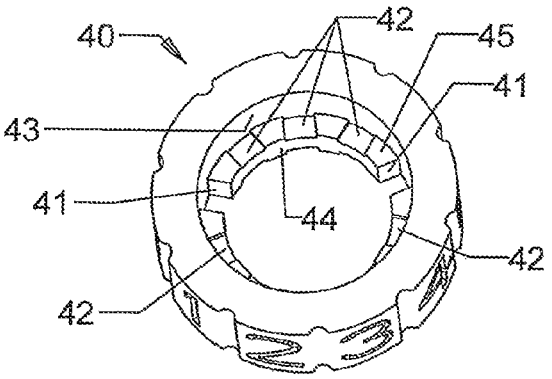
FIG. 4A is a top view of a dial.
Figure 4B:
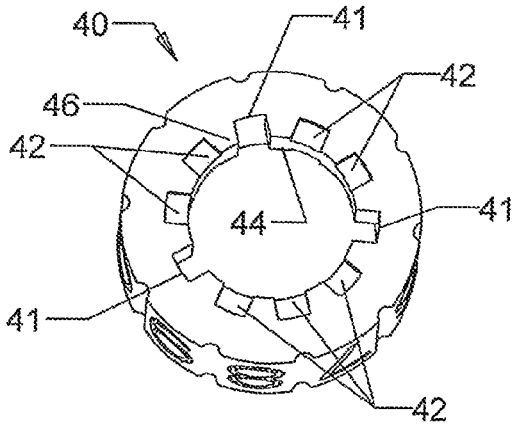
FIG. 4B is a bottom view of the dial.
Figure 5A:
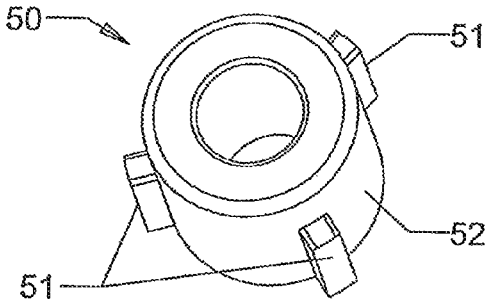
FIG. 5A is a top view of a clutch
Figure 5B:
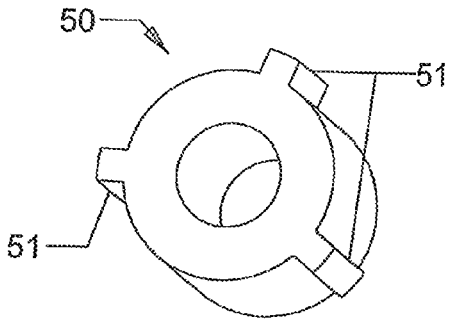
FIG. 5B is a bottom of the clutch.
Figure 6A:
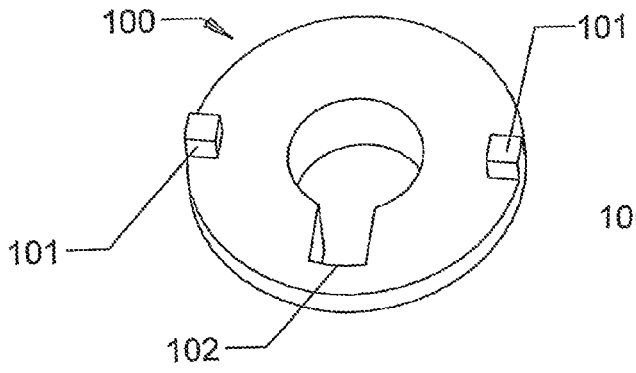
FIGS. 6A and 6B are different views of the directional plate.
Figure 6B:
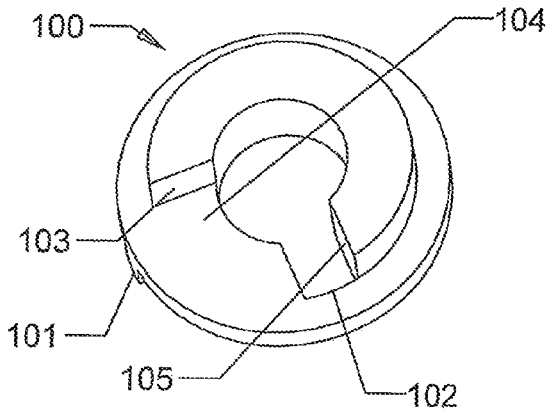
Figure 7A:
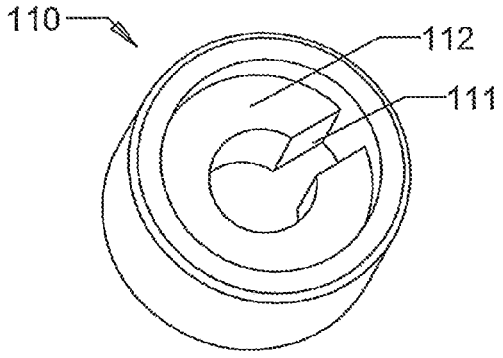
FIGS. 7A and 7B are different views of the bottom plug.
Figure 7B:
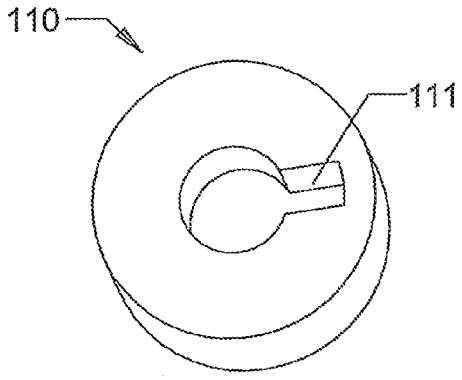

As seen in FIGS. 1-11B, the present invention is directed to a combination padlock 10 having a lock body 30 of a solid, single-piece construction, wherein two bolts 140, 150 in the lock body 30 are arranged to lock both the short leg 21 and the long leg 22 of shackle 20 when the padlock 10 is in the locked mode. A spindle 120 of a single-piece construction is used to control the engagement of bolts 140, 150 with the shackle 20 and the disengagement of the bolts 140, 150 from the shackle 120. The single-piece construction of the lock body 30 and the spindle 120 enhances the durability of the padlock in tensile test and impact test. The spindle 120 is located entirely within a spindle channel 34 of the lock body 30 when the padlock 10 is in the locked mode. But when the padlock 10 is in the opened mode, a top part of the spindle 120 is located outside the spindle channel 34, making it easy to reset the padlock. Furthermore, each of the dials 40 has a plurality of faulty notches 42 so as to increase the level of difficulty in picking the padlock. One distinctive feature of the present invention is that the clutches 50 are prevented from rotation relative to the spindle 120 when the padlock 10 is in the locked mode and in the opened mode.

The lock body 30 of the padlock 10 has a plurality of dial slots 35 dimensioned for mounting a number of dials 40. The lock body 40 has a plurality of ratchet pin holes 37 in communication with the dial slots 35 such that a ratchet pin 60 and a ratchet spring 70 are inserted in each of the ratchet pin holes 37 to provide an urging force against the dial 40 in the dial slot 35. A sealing plug 80 is applied to each of the ratchet pin holes 37 to seal the ratchet pin hole 37. The lock body 30 also has a bolt hole 33 for placing two bolts 140, 150 inside the lock body 30 and a bolt sealing plug 160 to seal the bolt hole 33. The bolts 140, 150 are separated from each other by the spindle 120 inside the lock body 30.

The lock body 30 has a first surface 38 and an opposing second surface 39. The lock body has a spindle channel 34 extending from the first surface 38 to the second surface 39, arranged to receive the spindle 120. The spindle 120 has a first end and a second end 1202. The spindle 120 has a clutch stopper 123 and a circular groove 124 for mounting C-clip 90 so as to define a clutch-mounting portion 128. The padlock 10 has a stack of clutches 50 rotatably mounted on the clutch-mounting portion 128 of the spindle 120. The padlock 10 also has a plurality of dials 40 positioned in relationship to the clutches 50. Each of the clutches 50 is associated with a different dial 40 to form a dial-clutch pair. Each of the dials 40 has an inner surface 43 and an extended inner ring 44 extended from the inner surface 43. Each of the dials 40 has one or more open slots 41 made on the extended inner ring 44 through the ring thickness; and a plurality of faulty notches 42 formed on the upper surface 45 and on the lower surface 46 of the extended ring 44, but through only a part of the ring thickness. Each of the clutches 50 has a substantially cylindrical outer surface 52 and one or more fins 51 extended from the cylindrical outer surface 52. The fins 51 of the clutch 50 are arranged to engage the opening slots 41 of an associated dial 40 when the padlock 10 is operated in the opened mode and in the reset mode.

The lock body 30 has a plurality of dial slots 35 and a plurality of clutch slots 36. Each of dial slots 35 is dimensioned to receive one of the dials 40 and each of clutch slots 36 is dimensioned to receive one of the clutches 50. Each of the clutch slots 36 has a plurality of openings 136 to receive the fins 51 of a clutch 50. In the locked mode and in the opened mode, the fins 51 of each of the clutches 50 are engaged with the fin slots 136 of an associated clutch slot 36. As such, the clutches 50 are prevented from rotation relative to the spindle 120.

When the padlock 10 is in the locked mode, the fins 51 of the clutch 50 are engaged in the fin slots 136 but are disengaged from the open slots 41 of the associated dial 40. Thus, the turning of the dials 40 has no effect on the clutches 50. This means that it would be very difficult for an intruder to peek into the lock body to see the fins 51 of the clutch 50 in order to align all clutches 50 for opening the lock. Furthermore, as the fins 51 rub against the faulty notches 42 when a dial 40 is rotated relative to the associated clutch 50, the faulty notches 42 make a clicking sound, rendering it difficult for an intruder to feel the correct open slot 41 by turning dials 40 in order to pick the combination.

The shackle 20 has a short leg 21 and a long leg 22. The short leg 21 has a bolt groove 23 and the long leg 22 has a bolt groove 24. The lock body 30 has a short-leg locking hole 21 and a long-leg locking channel 32. The short-leg locking hole 21 is made on the first surface 38 into part of the lock body 30 and arranged to engage the short leg 21 of the shackle 20 when the padlock is operated in the locked mode. The long-leg locking channel 32 is also made on the first surface 38 into part of the lock body 30, dimensioned to receive the long leg 22 of the shackle 20.

According to an embodiment of the present invention, the spindle 120 has a locking area 127 at the first end of the spindle 120, and a circular unlocking groove 122 between the locking area 127 and the clutch stopper 123. The spindle 120 has a step 126 at the second end 1202 of the spindle 120. The step 126 is dimensioned to be placed and riveted in a rivet-edge hole 131 of a button 130 so as to make the button 130 an integral part of the spindle 120. When the padlock 10 is operated in the locked mode, the spindle 120 is substantially located within the spindle channel 34. In this spindle position, the locking area or surface 127 of the spindle 120 is configured to push the bolts 140, 150 against the bolt grooves 23, 24 of the shackle 20 so as to keep the padlock 10 in the locked mode. The spindle 120 has a pin hole 125 arranged to receive a reset pin 170. Part of the reset pin 170 is press-fitted into the pin hole 125 and the exposed part of the reset pin 170 is placed through a channel 102 of a directional plate 100. The directional plate 100 restricts the rotational movement of the spindle 120 during the locked mode.

After the reset pin 170 is press-fitted in the pin hole 125 of the spindle 120, the directional plate 100 and an end plug 110 are assembled onto the spindle 120. The end plug 110 is placed below the directional plate 100. The end plug 110 has a pin channel 111 arranged to receive the reset pin 170 when the padlock 10 is in the opened mode. Once the end plug 110 has been assembled, the directional plate 100 cannot move upward or downward relative to the lock body 30. The lock body 30 is constructed such that while the padlock 10 is in the opened mode, the reset pin 170 is allowed to move in the upward or downward movement within the pin channel 111 of the end plug 110. The upward movement of the reset pin 170 is restricted by the plate surface 104 of the directional plate 100. The directional plate 100 has two extended tips 101 dimensioned to engage the fin slots 136 of the bottom clutch slot 36 in the lock body 30. As such, the directional plate 100 cannot rotate, move upward or move downward relative to the lock body 30.

Each of the dials 40 has one or more faulty notches 42 which help make the padlock 10 harder to pick. Each of the dials 40 is associated with a different one of the clutches 50 to form a dial-clutch pair. The clutches 50 are assembled as a stack between the clutch stopper 123 of the spindle 120 and the circular groove 124 of the spindle 120. The circular groove 124 is dimensioned for insertion of a C-clip 90 in order to hold the stack of clutches 50 together. The C-clip 90 and the clutch stopper 123 define the clutch-mounting portion 128 of the spindle 120.

When the user has turned and aligned the dials 40 according to the combination code, the spindle 120 can be pushed upward until the reset pin 170 moves out of the pin channel 111 of the end plug 110 and contacts the plate surface 104 of the directional plate 100. If the user wants to reset the padlock 10, the user can use a turn groove 121 on top of the spindle 120 to rotate the spindle 120. Because of the restriction of the stop edge 103 on the directional plate 100, the user can only rotate the spindle 120 in one direction, away from the stop edge 103, until the reset pin 170 hits the reset edge 105 of the directional plate 100. The reset pin 170 is now aligned with the plate channel 102 of the directional plate 100. At this position, the reset pin 170 can move into the plate channel 102 of the directional plate 100 when the spindle 120 is pushed further upward to place the lock in the reset mode. In the reset mode, the fins 51 of the clutches 50 are disengaged from the fin slots 136 in each of the clutch slots 36 of the lock body 30. The fins 51 of each of the clutches 50 now reside inside the open slots 41 of the associated dial 40. As such, the clutch 50 is caused to rotate along with the associated dial 40. The user can rotate the dials 40 to set a new combination code.

An important feature of the padlock 10 is that the open slots 41 are located in each of the dials 40, and each of the clutch slots 36 has a plurality of fin slots 136 to receive the fins 51 of a clutch 50. As such, the fins 51 are engaged with the fin slots 136 when the lock is in the locked mode. If there are ten digits or characters on each of dials to form a combination code, then there are ten fin-slots 136 in each clutch slot 36 on the lock body 30.

Locked Mode (FIG. 1A-9B):

As seen in FIG. 1A, the bolts 140, 150 are engaged with the spindle 120 such that the locking area 127 of the spindle 120 pushes the bolt 140 against the lock bolt groove 23 on the short leg 21 and the bolt 150 against the lock bolt groove 24 on the long leg 22 of the shackle 20. As such, the shackle 20 cannot be pulled upward to release the short-leg 21 of the shackle 20 from the short-leg locking hole 31 of the lock body 30.

The padlock 10 has a plurality of dials 40 and a plurality of clutches 50 to form a plurality of dial-clutch pairs. Each of the clutches 50 has one or more fins 51. Each of the dials 40 has one or more open slots 41 dimensioned to receive the fins 51 of the associated clutch 50. The stack of clutches 50 is assembled between the clutch stopper 123 of the spindle 120 and the circular groove 124 of the spindle 120 with a C-clip 90 inserted in the circular groove 124 to hold the clutches 50 in place. In this manner the upward/downward movement of the spindle 120 is only controlled by the alignment of the fins 51 of the clutch 50 and the open slots 41 of the associated dial 40 in each of the dial-clutch pairs.

The fins 51 of each of the clutches 50 are engaged with the fin slots 136 in the associated clutch slot 36 of the lock body 30 when the padlock 10 is in the locked mode and in the opened mode. The engagement prevents the clutches 50 from rotation relative to the spindle 120. When the padlock 10 is in the locked mode, the fins 51 in each of the clutches 50 are disengaged from the open slots 41 of the associated dial 40. Thus, the dials 40 can be rotated relative to the clutches 50. Each dial 40 has faulty notches 42 to render the lock harder to pick. If one of the fins 51 of the clutch 50 does not align with one of the open slots 41 of the dial 40 in at least one dial-clutch pair, the spindle 120 cannot be moved upward to open the lock.

The padlock 10 has a directional plate 100 placed below the C-clip 90 on spindle 120 and an end plug 110 press-fitted in the lock body 30 through the spindle channel 34, below the directional plate 100. In this relationship, the user cannot push the spindle 120 downward to open the lock because the C-clip 90 is arranged to contact the directional plate 100. The padlock 10 also has a button 130 with a rivet-edge hole 131 riveted onto the step 126 of the spindle 120. The button 130 makes it easier for the user to push the spindle 120 upward.

The directional plate 100 has two extended-tips 101 arranged to engage the fin slots 136 in the bottom clutch slot 36 of the lock body 30. This engagement prevents the directional plate 100 from being rotated in all modes.

The spindle 120 has a reset pin 170 which is press-fitted or riveted into the pin hole 125 of the spindle 120. The end plug 110 has a pin channel 111 to receive the reset pin 170 when the padlock 10 is in the locked mode, preventing the rotation of the spindle 120 relative to the lock body 30. The lock body 30 also has a long-leg locking channel 32 to receive the long leg 22 of the shackle 20.

Unlocked by Combination Code (FIG. 10A-10B):

Each of the dials 40 has one or more open slots 41 to receive the fins 51 of a clutch 50. When all of the fins 51 of each of the clutches 50 align with the open slots 41 of the associated dials 40, the spindle 120 can be pushed upward (in a first direction). As the spindle 120 is pushed upward, the locking area 127 is caused to move away from the bolts 140 and 150, allowing the bolt 140 and bolt 150 to move away from the bolt grooves 23 and 24 toward the unlocking groove 122 of the spindle 120. The shackle 20 can be pulled upward to release the short-leg 21 of the shackle 20 from the short-leg locking hole 31. The shackle 20 has a side cutout surface 25 and a neck 26 end at a wall 27. As the spindle 120 is pushed upward, the side cutout surface 25 allows the bolt 150 to move from the bolt groove 24 to the neck 26 and then to the wall 27 of the shackle 20. The contact of the bolt 150 and the wall 27 limits the upward movement of shackle 20.

When the spindle 120 is pushed upward, the reset pin 170 in the pin channel 111 of the end plug 110 is caused to move upward until the reset pin 170 contacts the plate surface 104 of the directional plate 100. The contact of the reset pin 170 and the plate surface 104 restricts the upward movement of the spindle 120 within the spindle channel 34. As such, each of the fins 51 of a clutch 50 is partially engaged with an open slot 41 of the associated dial 40 and partially engaged with one of the fin slots 136 in the associated clutch slot 36 the lock body 30. This partial engagement prevents the clutches 50 and the dials 40 from movement relative to the lock body 30 when the padlock 10 is in the opened mode. The above-described feature prevents an accidental change of the combination code.

Reset Combination (FIG. 11A-11B):

As seen in FIG. 11A, the bottom of each of the clutches 50 is located near the bottom of the associated dial 40. A further upward movement of the spindle 120 can disengage the fins 51 of the clutches 50 from the fin slots 136 in the associated clutch slot 36 of the lock body 30 and further engage the fins 51 with the open slots 41 of the associated dial 40. Thus, in the reset mode, the dials 40 and the clutches 50 can be rotated relative to the spindle 120.

The directional plate 100 is configured to restrict the rotational movement of the spindle 120 when the lock is in the opened mode because of the stop edge 103 on the directional plate 100. The user can rotate the spindle 120 in the clockwise direction until the reset pin 170, which is press-fitted in the pin hole 125 of the spindle 120, is in contact to the reset edge 105 of the directional plate 100. In this position, the reset pin 170 aligns with the channel 102 of the directional plate 100. This allows the user to push the spindle 120 further upward so that the reset pin 170 moves into the channel 102. As described above, the fins 51 of each clutch 50 become completely disengaged from the fin slots 136 in the associated clutch slot 36 of the body 30 and the fins 51 of each clutch 50 reside within the associated dial 40. Thus, the user can turn the dials 40 to set a new combination code. The turning of the dials 40 also rotates the clutches 50 simultaneously. After a new combination code has been set, the user can push the spindle 120 downward until the reset pin 170 contacts the flat surface 112 of the end plug 110. The user can then rotate the spindle 120 in the counter-clockwise direction such that the reset pin 170 is caused to rotate until it contacts the stopping edge 103 of the directional plate 100. At this position, the reset pin 170 is again aligned to the pin channel 111 of the end plug 110, and the user can push the shackle 20 downward so that the short leg 21 of the shackle 20 is moved into the short-leg locking-hole 31. In this shackle position, the bolts 140, 150 are aligned with the bolt groove 23, 24 of the shackle 20. The user can then push the spindle 120 downward such that the unlocking groove 122 is caused to push the bolts 140, 150 toward the bolt grooves 23, 24. As the spindle 120 moves further downward, the locking area 127 of the spindle 120 contacts the bolts 140, 150. The lock is in the locked mode after the dials 40 are scrambled.

Although the present invention has been described with respect to one or more embodiments thereof, it will be understood by those skilled in the art that the foregoing and various other changes, omissions and deviations in the form and detail thereof may be made without departing from the scope of this invention.

What is claimed is:

1. A padlock operable at least in a locked mode and an opened mode, comprising:

a lock body comprising a first surface and a second surface, a short-leg locking hole and a long-leg locking channel made on the first surface into part of the lock body, and a spindle channel extending from the first surface to the second surface;

a shackle locatable in a first shackle position when the padlock is operated in the locked mode, and in a second shackle position when the padlock is operated in the opened mode, the shackle having a short leg, a long leg, a first bolt groove formed on the short leg and a second bolt groove formed on the long leg, the long leg arranged for placement in the long-leg locking channel, the short leg arranged to engage with the short-leg locking hole when the shackle is in the first shackle position, and to disengage from the short-leg locking hole when the shackle is in the second shackle position;

a first bolt arranged to engage the first bolt groove inside the lock body;

a second bolt arranged to engage the second bolt groove inside the lock body;

a spindle dimensioned for placement in the spindle channel, the spindle having a locking area adjacent to the first surface of the lock body, a clutch-mounting portion, and an unlocking groove located between the locking area and clutch-mounting portion, the spindle locatable in a first spindle position and a second spindle position;

a plurality of clutches rotatably mounted on the clutch-mounting portion of the spindle;

a plurality of dials positioned in relationship to the plurality of clutches so as to lock the spindle in the first spindle position or to allow the spindle to move in a first direction from the first spindle position to the second spindle position, wherein when the spindle is in the first spindle position, the spindle is substantially located within the spindle channel such that the locking area of the spindle is arranged to engage the first bolt with the first bolt groove and to engage the second bolt with the second bolt groove so as to secure the shackle in the first shackle position; and when the spindle is in the second spindle position, a portion of the spindle is located outside the spindle channel such that the locking area of the spindle is spaced from the first bolt and the second bolt, allowing the first bolt to move away from the first bolt groove toward the unlocking groove and the second bolt to move away from the second bolt groove toward the unlocking groove so as to allow the shackle to move from the first shackle position to the second shackle position.

2. The padlock according to claim 1, wherein each of the clutches has an outer surface and at least one fin extended from the outer surface, and each of the dials has an inner surface, an extended inner ring extended from the inner surface, and at least one open slot made on the extended inner ring, said at least one open slot dimensioned to receive said at least one fin of a clutch, wherein the lock body comprises a plurality of dial slots, each dial slot dimensioned to receive one of the dials, and a plurality of fin slots, each fin slot dimensioned to receive said at least one fin of one of the clutches, and wherein the plurality of dials and the plurality of clutches are arranged to form a plurality of dial-clutch pairs, each dial-clutch pair having a clutch and an associated dial, wherein when the padlock is operated in the locked mode, said at least one fin of the clutch in a dial-clutch pair is engaged with the associated fin slot of the lock body but disengaged from said at least one open slot of the associated dial so as to allow the dial to rotate relative to the spindle, and when the padlock is operated in the opened mode, said at least one fin of the clutch is partially engaged with said at least one open slot of the associated dial and partially engaged with the associated fin slot of the lock body, so as to prevent both the dial and the clutch from rotation relative to the spindle.

3. The padlock according to claim 2, wherein when the padlock is operated in the locked mode, the spindle is prevented from moving in the first direction if, in at least one of the dial-clutch pairs, said at least one fin of the clutch is misaligned with said at least one open slot of the dial.

4. The padlock according to claim 2, wherein when the padlock is operated in the locked mode and, in each of the dial-clutch pairs, said at least one fin of the clutch aligns with said at least one open slot of the dial according to a combination code, the spindle is allowed to move in the first direction from the first spindle position to the second spindle position.

5. The padlock according to claim 4, wherein the spindle has a first end having the locking area and an opposing second end, the spindle further comprising a reset pin fixedly attached to the spindle near the second end, a directional plate movably mounted on the spindle between the clutch-mounting portion and the reset pin, and an end plug movably mounted on the spindle in relationship to the reset pin, the end plug having a pin channel arranged to receive the reset pin such that when the spindle is in the first spindle position, the reset pin is located in the pin channel of the end plug, preventing the spindle from rotating relative to the lock body.

6. The padlock according to claim 5, wherein the directional plate has a plate surface positioned in relationship with the end plug such that when the spindle is moved from the first spindle position to the second spindle position, the reset pin is caused to move out of the pin channel of the end plug and to contact the plate surface of the directional plate, the plate surface configured to prevent the spindle from moving in the first direction further from the second spindle position.

7. The padlock according to claim 6, wherein when the spindle is in the second spindle position, the spindle, along with the reset pin, is allowed to rotate relative to the end plug, and wherein the directional plate further has a plate channel arranged such that when the reset pin aligns with the plate channel, the spindle can be caused to move in the first direction further from the second spindle position so that said at least one fin of each of the clutches is disengaged from the associated fin slot of the lock body while engaging with said at least one open slot of the associated dial, allowing a user to rotate one or more of the dials along with the clutches to change the combination code.

8. The padlock according to claim 2, wherein the extended inner ring has a thickness and each of said at least one open slot is made on the extended inner ring through the thickness, and wherein each of the dials further comprises a plurality of faulty notches made on the extended inner ring through only a part of the thickness such that when the clutch in a dial-clutch pair is caused to rotate relative to the associated dial, said at least one fin of the clutch is arranged to rub against the faulty notches of the associated dial.

9. The padlock according to claim 8, wherein the faulty notches are configured to produce a clicking sound when said at least one fin of the clutch rubs against the faulty notches of the associated dial.

10. The padlock according to claim 2, wherein said at least one fin comprises a plurality of fins distributed on the outer surface of each of the clutches, and said at least one open slot comprises a plurality of open slots distributed on the extended inner ring of each of the dials.

11. The padlock according to claim 10, wherein the plurality of fins are distributed on the outer surface of each of the clutches in a fin distribution pattern, and the plurality of open slots are distributed on the extended inner ring of each of the dials in a slot distribution pattern matching the fin distribution pattern such that the plurality of open slots on each of the dials are configured to receive the plurality of fins of an associated clutch in only one manner.

* * * * *